US005674137A

United States Patent [19]

Maruko et al.

[11] Patent Number: 5,674,137

[45] Date of Patent: Oct. 7, 1997

[54] WOUND GOLF BALL

[75] Inventors: Takashi Maruko; Shinichi Kakiuchi; Junji Hayashi, all of Chichibu, Japan

[73] Assignee: Bridgestone Sports Co., Ltd., Tokyo, Japan

[21] Appl. No.: 510,068

[22] Filed: Aug. 1, 1995

[30] Foreign Application Priority Data

Aug. 3, 1994 [JP] Japan ..... 6-201389
Dec. 14, 1994 [JP] Japan ..... 6-333025

[51] Int. Cl.[6] ..... A63B 37/08

[52] U.S. Cl. ..... 473/354; 473/351; 473/361; 473/378

[58] Field of Search ..... 473/363, 354, 473/357, 358, 359, 360, 361, 362, 364, 351, 378

[56] References Cited

U.S. PATENT DOCUMENTS 701,736 6/1902 Kempshall ..... 473/365
4,272,079 6/1981 Nakade et al. ..... 473/363
4,337,946 7/1982 Saito et al. ..... 473/363 X

*Primary Examiner*—George J. Marlo
*Attorney, Agent, or Firm*—Sughrue, Mion, Zinn, Macpeak & Seas

[57] ABSTRACT

A wound golf ball comprising a liquid center, thread rubber wound thereon, and a cover enclosing the wound center, wherein said cover has a multi-layer structure having a total thickness of 1.0 to 4.0 mm and including an outer layer having a first hardness and a thickness of 0.4 to 3.0 mm and an inner layer having a second hardness higher than the first hardness, the outer layer of said cover being formed of a first resin having a Shore D hardness of 40 to 55, and the inner layer is formed of a second resin having a Shore D hardness of 55 to 68, the difference in hardness between the first and second resins being at least 5 in Shore D hardness.

2 Claims, 1 Drawing Sheet

WOUND GOLF BALL

BACKGROUND OF THE INVENTION

1. Field of the Invention

This invention relates to a thread wound golf ball which is durable while affording a satisfactory flying distance and controllability.

2. Prior Art

Prior art thread wound golf balls with a solid center have two types of covers, that is, ionomer resin covers and balata rubber covers. For simplicity, the thread wound golf balls having a cover of ionomer resin are referred to as wound ionomer balls while the thread wound golf balls having a cover of balata rubber are referred to as wound balata balls. They have advantages and disadvantages. The wound ionomer balls are superior in flying distance when struck with the driver, but considerably inferior in spin properties in the approach play on the green, that is, stoppage on the green. The wound balata balls are less durable, for example, in that their cover at the ball surface can be scuffed or fretted by bunker shots and cut when topped with iron clubs.

For the purpose of improving spin property and durability, a wound golf ball using a softer ionomer resin as the cover was also proposed. This ball has problems that it has little difference in the flying distance associated with the driver from the conventional wound golf balls and that it can be cut in the cover when topped with iron clubs as are the wound balata balls.

SUMMARY OF THE INVENTION

An object of the present invention is to provide a wound golf ball which is satisfactory in flying distance and spin property and is fully durable.

The present invention relates to a thread wound golf ball having a center ball, thread rubber, and a cover. The cover has a multi-layer structure including an outer layer and an inner layer. The inner layer has a higher hardness than the outer layer. The outer layer has a radial thickness of 0.4 mm or more. The resulting wound golf ball affords a flying distance at least comparable to that of the conventional wound ionomer balls having a cover of high hardness ionomer resin. Its spin property is comparable to that of the conventional wound balata balls. Its cover is not readily cut when topped with iron clubs.

Although two-piece solid golf balls having a cover of two-layer structure are known in the art as disclosed in Japanese Patent Application Kokai (JP-A) Nos. 80469/1985 and 290969/1986 and EP 577,058, a two-layer cover has never been proposed for wound golf balls. The thread wound golf ball having a cover of the above-defined layer structure according to the present invention affords the following advantages. Since the cover outer layer has a lower hardness or adequate softness, the ball gains a high spin rate and offers good spin properties and controllability on approach shots. Since the cover inner layer has a higher hardness, the cover as a whole offers good repulsion or restitution, an increased initial velocity with a low spin rate, and an increased flying distance on driver shots. A combination of the outer layer having a lower hardness with the inner layer having a higher hardness improves cut resistance and hence, durability. The outer layer formed of an ionomer resin having a lower hardness has higher scuffing resistance and hence, more durable than the balata covers and high hardness ionomer resin covers.

According to the present invention, there is provided a wound golf ball comprising a center ball, a thread rubber layer, and a cover wherein the cover has a multi-layer structure including an outer layer having a thickness of at least 0.4 mm and an inner layer having a hardness higher than that of the outer layer.

BRIEF DESCRIPTION OF THE DRAWINGS

The only FIGURE.

BEST MODE FOR CARRYING OUT THE INVENTION

Figure 1:
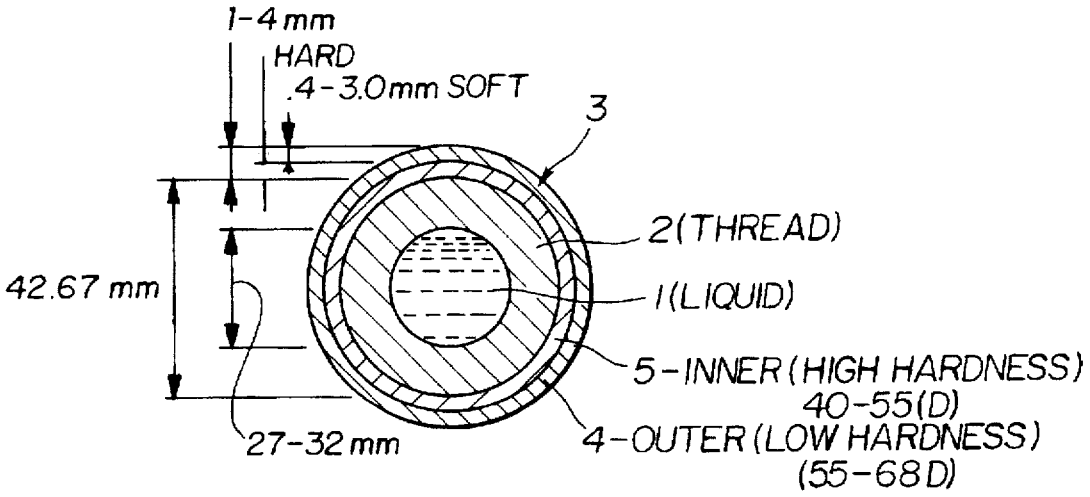
FIG. 1 is a schematic cross-sectional view of one exemplary wound golf ball.

Referring to FIG. 1, a wound golf ball is illustrated as comprising a spherical center ball 1. Thread rubber is wound on the center ball 1 to form a thread rubber layer 2, which is enclosed in a cover 3. According to the invention, the cover 3 has a multi-layer structure, typically a two layer structure consisting of a radially outer layer 4 and a radially inner layer 5.

Each of the outer and inner layers 4 and 5 is generally formed of a composition comprising a well-known cover resin such as ionomer resins and balata rubber and conventional amounts of optional additives including pigments such as titanium white and dispersants such as magnesium stearate. The outer layer has a first hardness which is relatively low and the inner layer has a second hardness which is higher than the first hardness.

The outer layer is preferably formed of a resin having a Shore D hardness of 40 to 55, more preferably 45 to 51. Useful resins are ionomer resins, for example, Himilan 8120, 8220 and 8320 commercially available from Mitsui-dupont Polychemical K. K. and mixtures of two or more of them as well as balata rubber.

The inner layer is preferably formed of a resin having a Shore D hardness of 55 to 68, more preferably 60 to 66. Useful resins are ionomer resins, for example, Himilan 1554, 1555, 1601, 1702, 1705, and 1706 commercially available from Mitsui-duPont Polychemical K. K. and mixtures of two or more of them.

The difference in hardness between the inner and outer layer resins should preferably be at least 5, especially at least 10 in Shore D hardness.

According to the present invention, the outer layer should have a radial thickness of at least 0.4 mm, preferably 0.4 to 3.0 mm, more preferably 0.4 to 2.0 mm. It is recommended that the outer and inner layers have a total thickness of 1.0 to 4.0 mm, especially 1.5 to 2.5 mm. If the total thickness is less than 1.0 mm, the cover would be less durable against topping. If the total thickness is beyond 4.0 mm, the ball would be sometimes low in initial velocity. An outer layer of less than 0.4 mm fails to provide spin properties on approach shots. The ratio of the outer layer thickness to the inner layer thickness is desirably from 3:7 to 7:3.

The wound golf ball of the invention may have either a liquid center or a solid center, which are both conventional. The liquid center typically consists of a rubber or center bag filled with a liquid. The rubber or center bag may be formed of any well-known composition. Water is the preferred liquid. The fill liquid preferably has a specific gravity of at least 0.9, more preferably 1.0 to 1.5, most preferably 1.0 to 1.2. Fine powder, surfactant or the like may be added to water for adjusting the specific gravity. The fine powder used herein is one which consists of fine particles and is not dissolved in water. Typical examples are fillers such as barium sulfate, zinc oxide, and silica. The powder preferably has a mean particle size of 0.02 to 100 μm, especially 0.5 to 20 μm. The powder may be blended in an amount of 4 to 60% by weight, especially 10 to 50% by weight of the fill liquid. Exemplary surfactants are dodecylbenzenesulfonic acid and sodium dodecylbenzenesulfonate. Water is the preferred liquid. The rubber or center bag may be formed of any well-known composition. Also the solid center may be of a well-known composition.

The center ball preferably has an outer diameter of 27 to 32 mm and a weight of 15.0 to 23.0 g, especially 17.5 to 21.5 g.

The type of thread rubber wound on the center ball and the winding technique may be conventional.

After a core is formed by winding a thread rubber layer on the center ball, any desired technique may be used in enclosing the core in a cover of multi-layer structure. For example, each covering composition is directly injection molded around the core. Alternatively, a pair of hemispherical cups are formed from each covering composition and the core is surrounded by the dual cups, which is press molded at 110° to 160° C. for about 2 to 10 minutes.

The wound golf ball of the invention has a diameter and weight meeting the Golf Association Standards, that is, a diameter of at least 42.67 and a weight of up to 45.92 g.

EXAMPLE

Examples of the present invention are given below by way of illustration and not by way of limitation.

Examples 1–5 and Comparative Examples 1–5

A liquid center was prepared by molding a rubber composition of the formulation shown in Table 1 in a hemispherical mold cavity and vulcanizing it to form hemispherical shells. A pair of shells were mated to form a rubber bag which was filled with water. The center ball had an outer diameter of 29 mm and a weight of 18.8 g.

TABLE 1

| | Center bag A |
|---|---|
| Composition (pbw) | |
| Natural rubber | 100 |
| Stearic acid | 1 |
| Zinc oxide | 330 |

TABLE 1-continued

| | Center bag A |
|---|---|
| Processing oil | 30 |
| Vulcanization promoter | 1.5 |
| Sulfur | 2.5 |
| Physical properties as vulcanized | |
| Hardness, JIS A scale | 60 |
| Specific gravity | 2.27 |
| Bag gage, mm | 2.2 |

Thread rubber was wound on the liquid center ball by a conventional winding technique to form a thread rubber layer of about 6 mm thick.

Each cover composition was prepared by blending 100 parts by weight of a resin as shown in Table 2 with 5 parts by weight of titanium oxide and 0.3 parts by weight of magnesium stearate in a twin screw extruder. The cover composition was molded into hemispherical cups.

TABLE 2

| | Cover composition | | | |
|---|---|---|---|---|
| Ionomer resin (pbw) | R1 | R2 | R3 | R4 |
| H1557 (Zn) | 25 | — | — | — |
| S8120 (Na) | 50 | — | — | — |
| S8320 (Na) | — | 65 | 90 | — |
| H1605 (Zn) | — | — | — | 50 |
| H1650 (Zn) | — | 35 | 10 | — |
| H1706 (Zn) | — | — | — | 50 |
| H1856 (Na) | 25 | — | — | — |
| Cover resin hardness (Shore D) | 51 | 47 | 41 | 64 |

A wound golf ball was prepared by combining a pair of cups of one type with a pair of cups of another type in concentric overlap, mating a pair of dual cups so as to enclose the core therein, and compression molding the cups to form a cover.

Each of the thus prepared golf balls was tested for carry, total distance (carry+ run), spin, and elevation angle by hitting with the driver and sand wedge. The results are shown in Table 3. The ball was also examined for cut durability by hitting with the sand wedge at a head speed (ES) of 36 m/s.

TABLE 3

| | Example | | | | | Comparative Example | | | | |
|---|---|---|---|---|---|---|---|---|---|---|
| | 1 | 2 | 3 | 4 | 5 | 1 | 2 | 3 | 4 | 5 |
| Cover | | | | | | | | | | |
| Structure | 2 layer | 2 layer | 2 layer | 2 layer | 2 layer | 1 layer | 1 layer | 2 layer | 2 layer | balata |
| Outer layer (Shore D) | R1 (51) | R2 (47) | R3 (41) | R1 (51) | R1 (51) | R1 (51) | R4 (64) | R4 (64) | R1 (51) | (48) |
| Inner layer (Shore D) | R4 (64) | R4 (64) | R4 (64) | R4 (64) | R4 (64) | R1 (51) | R4 (64) | R1 (51) | R4 (64) | (48) |
| Thickness (mm) | 1.8 | 1.8 | 1.8 | 1.8 | 1.8 | 1.8 | 1.8 | 1.8 | 0.8 | 1.8 |
| Thickness ratio*1 | 5:5 | 5:5 | 5:5 | 3:7 | 7:3 | — | — | 5:5 | 4:6 | — |
| Performance | | | | | | | | | | |
| W#1, HS = 45 m/s Carry (m) | 211.5 | 210.7 | 210.05 | 211.6 | 210.6 | 209.7 | 211.7 | 211.6 | 211.1 | 209.5 |
| Total distance (m) | 228.9 | 228.4 | 228.1 | 229.1 | 228.2 | 226.5 | 229.3 | 229.2 | 228.5 | 226.1 |
| Spin (rpm) | 2880 | 2910 | 2990 | 2860 | 2950 | 3070 | 2830 | 2840 | 2900 | 3100 |
| Elevation angle (°) | 11.5 | 11.5 | 11.6 | 11.5 | 11.5 | 11.7 | 11.5 | 11.5 | 11.5 | 11.8 |
| W#1, HS = 50 m/s Carry (m) | 240.9 | 240.8 | 240.8 | 241.0 | 240.7 | 240.7 | 241.4 | 241.2 | 240.7 | 240.1 |

TABLE 3-continued

| | Example | | | | | Comparative Example | | | | |
|---|---|---|---|---|---|---|---|---|---|---|
| | 1 | 2 | 3 | 4 | 5 | 1 | 2 | 3 | 4 | 5 |
| Total distance (m) | 258.2 | 257.8 | 256.0 | 258.4 | 257.5 | 255.1 | 258.5 | 258.4 | 257.7 | 254.8 |
| Spin (rpm) | 2780 | 2800 | 2860 | 2760 | 2820 | 3000 | 2710 | 2720 | 2810 | 3050 |
| Elevation angle (°) | 11.4 | 11.4 | 11.5 | 11.4 | 11.4 | 11.6 | 11.4 | 11.4 | 11.4 | 11.7 |
| SW, HS = 20 m/s | | | | | | | | | | |
| Spin (rpm) | 6150 | 6250 | 6480 | 6130 | 6240 | 6250 | 4570 | 4590 | 6050 | 6300 |
| Cut durability*2 | 0/30 | — | — | — | — | 8/30 | 0/30 | — | 30/30 | — |
| SW, HS = 36 m/s | | | | | | | | | | |

*1Thickness ratio is outer layer thickness/inner layer thickness.
*2The number of balls with cover failure or ball distortion from sphericity It is evident that the wound golf balls of the present invention are improved in flying distance and spin property and are fully durable.

Japanese Patent Application No. 201389/1994 and No. 333025/1994 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. A wound golf ball comprising a liquid center, thread rubber wound thereon, and a cover enclosing the wound center, wherein said cover has a multi-layer structure having a total thickness of 1.0 to 4.0 mm and including an outer layer having a first hardness and a thickness of 0.4 to 3.0 mm and an inner layer having a second hardness higher than the first hardness, the outer layer of said cover being formed of a first resin having a Shore D hardness of 40 to 55, and the inner layer is formed of a second resin having a Shore D hardness of 55 to 68, the difference in hardness between the first and second resins being at least 5 in Shore D hardness.

2. The wound golf ball of claim 1 wherein said center ball has an outer diameter of 27 to 32 mm and a weight of 15.0 to 23.0 g.

* * * * *

UNITED STATES PATENT AND TRADEMARK OFFICE

CERTIFICATE OF CORRECTION

PATENT NO. : 5,674,137
DATED : October 7, 1997
INVENTOR(S) : Takashi Maruko et al.

It is certified that error appears in the above-identified patent and that said Letters Patent is hereby corrected as shown below:

Title page,
Showing the illustrative figure, should be deleted, and substitute therefor the attached title page.

Please delete Fig. 1 and insert Fig. 1 as shown below:

FIG.1

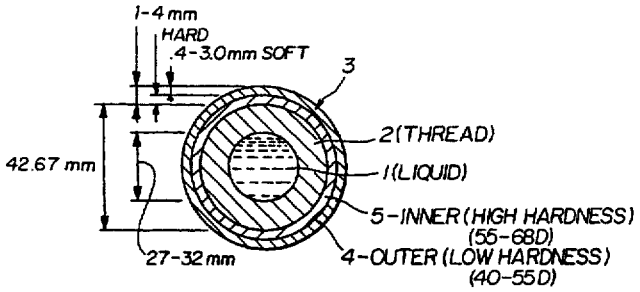

Signed and Sealed this

Sixteenth Day of October, 2001

*Attest:*

Nicholas P. Godici

*Attesting Officer*

NICHOLAS P. GODICI
*Acting Director of the United States Patent and Trademark Office*

United States Patent [19]

Maruko et al.

[11] Patent Number: 5,674,137

[45] Date of Patent: Oct. 7, 1997

[54] WOUND GOLF BALL

[75] Inventors: Takashi Maruko; Shinichi Kakiuchi; Junji Hayashi, all of Chichibu, Japan

[73] Assignee: Bridgestone Sports Co., Ltd., Tokyo, Japan

[21] Appl. No.: 510,068

[22] Filed: Aug. 1, 1995

[30] Foreign Application Priority Data

Aug. 3, 1994 [JP] Japan ..... 6-201389
Dec. 14, 1994 [JP] Japan ..... 6-333025

[51] Int. Cl.[6] ..... A63B 37/08

[52] U.S. Cl. ..... 473/354; 473/351; 473/361; 473/378

[58] Field of Search ..... 473/363, 354, 473/357, 358, 359, 360, 361, 362, 364, 351, 378

[56] References Cited

U.S. PATENT DOCUMENTS 701,736 6/1902 Kempshall ..... 473/365
4,272,079 6/1981 Nakade et al. ..... 473/363
4,337,946 7/1982 Saito et al. ..... 473/363 X

*Primary Examiner*—George J. Marlo
*Attorney, Agent, or Firm*—Sughrue, Mion, Zinn, Macpeak & Seas

[57] ABSTRACT

A wound golf ball comprising a liquid center, thread rubber wound thereon, and a cover enclosing the wound center, wherein said cover has a multi-layer structure having a total thickness of 1.0 to 4.0 mm and including an outer layer having a first hardness and a thickness of 0.4 to 3.0 mm and an inner layer having a second hardness higher than the first hardness, the outer layer of said cover being formed of a first resin having a Shore D hardness of 40 to 55, and the inner layer is formed of a second resin having a Shore D hardness of 55 to 68, the difference in hardness between the first and second resins being at least 5 in Shore D hardness.

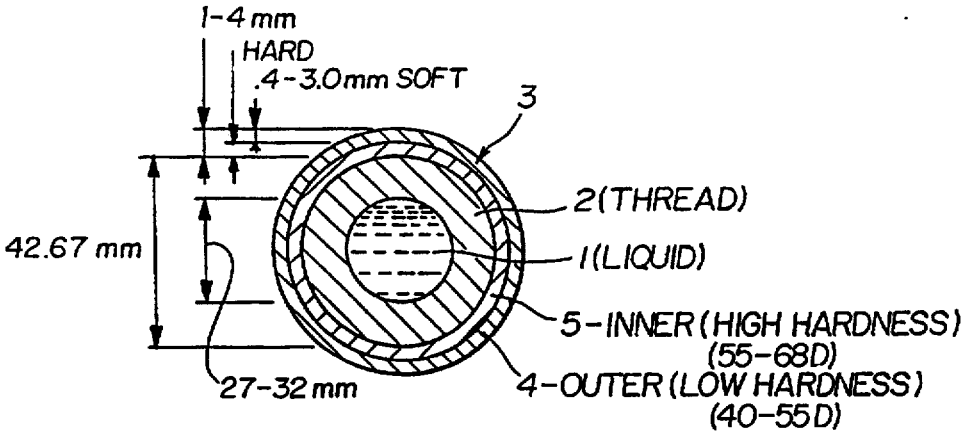

2 Claims, 1 Drawing Sheet